United States Patent [19]

Peeri

[11] 4,063,069

[45] Dec. 13, 1977

[54] ELECTRICALLY HEATABLE FLOOR CARPET

[76] Inventor: Menachem Peeri, 21, Hagefen St., Neve Monoson, Israel

[21] Appl. No.: 663,368

[22] Filed: Mar. 3, 1976

[51] Int. Cl.[2] ..... H05B 3/36

[52] U.S. Cl. ..... 219/545; 174/110 FC; 219/529; 219/549; 219/217; 338/210

[58] Field of Search ..... 219/211, 212, 217, 345, 219/527, 528, 529, 543, 545, 549; 338/208, 210, 211, 212; 174/110 FC

[56] References Cited

U.S. PATENT DOCUMENTS

| | | | |
|---|---|---|---|
| 1,036,632 | 8/1912 | Jahr | 219/545 X |
| 2,700,212 | 1/1955 | Flynn et al. | 174/110 FC X |
| 2,759,092 | 8/1956 | Fortin | 219/545 |
| 2,771,537 | 11/1956 | Lichtenstein | 219/529 |
| 2,782,289 | 2/1957 | Nathanson | 219/217 X |
| 2,812,409 | 11/1957 | Jones et al. | 219/545 X |
| 2,817,737 | 12/1957 | Morris | 219/545 X |
| 2,976,393 | 3/1961 | Illingworth | 219/529 |
| 3,057,952 | 10/1962 | Gordon | 174/110 FC X |
| 3,243,574 | 3/1966 | Baythe et al. | 219/245 X |
| 3,349,359 | 10/1967 | Morey | 338/208 |
| 3,408,453 | 10/1968 | Shelton, Jr. | 174/110 FC X |
| 3,425,020 | 1/1969 | Toyooka et al. | 219/529 X |
| 3,472,289 | 10/1969 | Webber et al. | 139/425 |
| 3,513,297 | 5/1970 | Jordan | 219/545 |
| 3,582,613 | 6/1971 | Pies | 219/307 |
| 3,616,177 | 10/1971 | Gumerman | 174/110 FC X |
| 3,684,755 | 8/1972 | Gumerman | 174/110 FC X |
| 3,889,101 | 6/1975 | Woods | 219/527 |
| 3,940,592 | 2/1976 | Shimuzu et al. | 219/545 X |

OTHER PUBLICATIONS

DuPont Product Engineering Bulletin, "Properties of Teflon", 52/1954, pp. 1–4.

*Primary Examiner*—Volodymyr Y. Mayewsky
*Attorney, Agent, or Firm*—Marshall & Yeasting

[57] ABSTRACT

An electrically heatable floor covering comprising a carpet of woven fibers, wherein an electrical heating element is enclosed in the carpet body, which is made of a straight thin copper wire having a reinforcing coating of polytetrafluoroethylene which causes the wire to withstand impressions produced by footsteps and by heavy furniture without being broken.

1 Claim, 2 Drawing Figures

ELECTRICALLY HEATABLE FLOOR CARPET

BACKGROUND OF THE INVENTION

The present invention relates to an electrically heatable floor covering on the basis of a fabric of natural and/or synthetic fibres, more particularly an electrically heatable carpet, in which a wire-shaped electrical heating element is enclosed in the carpet body.

In a well-known electrically heatable wall covering the electrical heating element is formed by a finely coiled resistance wire i.e. a wire of a material having a high specific resistivity. Such a construction could not be used for a floor carpet as the finely coiled resistance wire would be readily damaged and even broken as a result of the loads applied to the carpet, such as footsteps, impressions of (heavy) furniture pieces etcetera.

It is also known to apply an electrically conducting paint in a zig-zag pattern on a carrier of plastics material, such as polyester and to connect such carrier to the proper wall covering, for example wall "paper." Such a heating element in the form of a zig-zag ribbon of electrically conducting paint (so-called carbon paint) could not be applied in a floor carpet either, as the electrically conducting paint would soon break under the influence of the mechanical loads exerted on the carpet in use. For this reason this type of wall covering is used only as electrically heated wall "paper" and as ceiling covering.

From the standpoint of heat distribution heating from the floor covering would be advantageous, as in this manner a temperature gradient — considered from the floor to the ceiling of the room to be heated — could be realized which corresponds with the ideal temperature gradient, according to which the room temperature has its maximum value adjacent the floor and decreases towards the ceiling.

SUMMARY OF THE INVENTION

Therefore it is the object of the present invention to provide an electrically heatable covering which is more particularly adapted to be used as a floor carpet as the electrical heating element(s) is (are) capable of withstanding the loads exerted on it in use, such as footsteps, impressions by furniture pieces etcetera.

For this purpose in accordance with the present invention the electrical heating element is constituted by a straight thin wire of copper or a comparable electrically conducting material, which wire is coated by an electrically insulating high-temperature material, such as polytetrafluoroethylene, known under the name Teflon.

This means that according to the invention for the heat development use is made of a material having a relatively low specific resistivity, which is normally applied in connection with its heat conducting properties rather than in connection with its heat developing properties.

The advantage of a thin wire of copper or comparable material is to be seen in that such a wire, in combination with the outstanding mechanical strength of the coating of polytetrafluoroethylene will successfully withstand all of the loads exerted on the carpet in use.

In order to further increase the flexibility of the electrical heating element a stranded wire of copper or similar material is used. An electrical heating element of this structure may be considered as absolutely safe.

An electrical heating element as proposed by the present invention may be woven into the carpet body in a simple way during the normal carpet weaving process. For example the Teflon-coated copper wire may be inserted in the carpet body as a weft thread.

Figure 1:
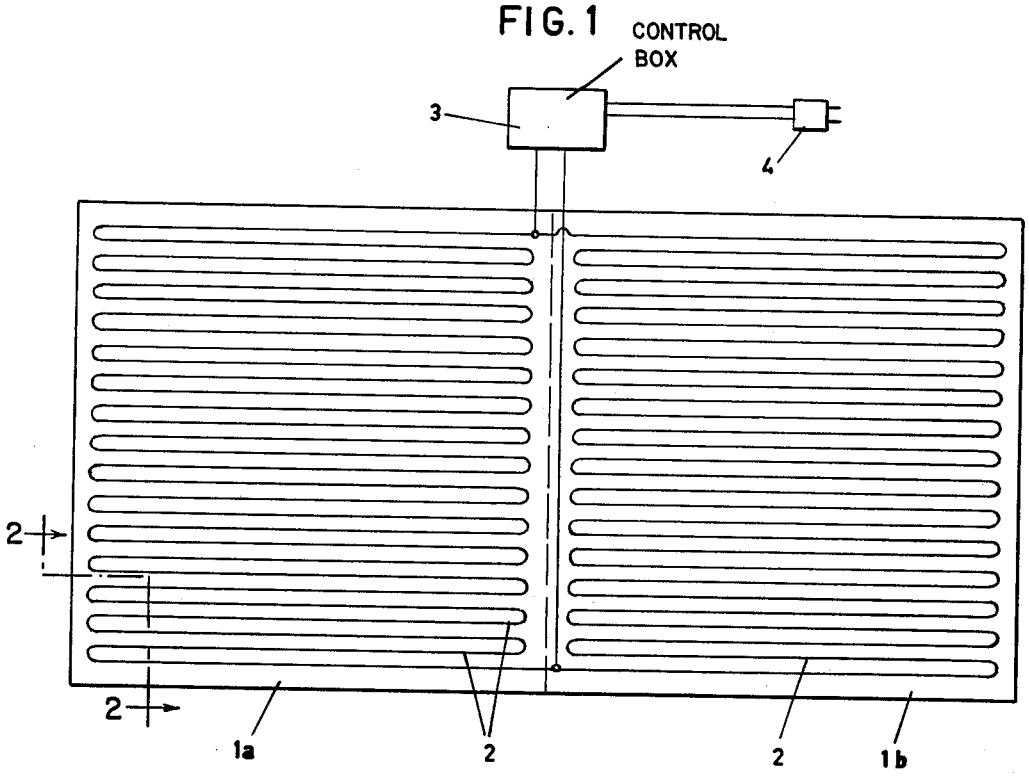
FIG. 1 is a diagrammatic plan view of a carpet according to the present invention and FIG. 2 is a section taken on the line 2—2 of FIG. 1, which shows how the heating element is interwoven in the carpet body.

In the example shown in FIG. 1, the carpet consists of two sections 1*a* and 1*b*. In each of these two sections the wire-shaped element 2 is formed into a zig-zag pattern which covers the whole area of the section. The electrical heating element 2 consists of a thin wire of copper, which is coated by an electrically insulating high-temperature material, namely polytetrafluoroethylene. The wire portions extending between the bends or curves of the zig-zag pattern are straight rather than being coiled as in the well-known electrically heated wall coverings. The distance between two adjacent straight wire portions is for example 6 cm, whereas the area of a carpet section is for example 4 $m^2$ (2 × 2 m). This means that the total length of heating wire is about 60 m per carpet section.

For the heating wire 2 it is advantageous to make use of a type of electrical conductor, which is applied in space craft. More particularly the types E30 and E28, manufactured by Essex International Corporation, are suitable for this purpose. The types just referred to relate to stranded wires (each consisting of seven elementary wires, each elementary wire having a diameter of about 0.1 mm) of nickel-or silver-coated copper, covered by an extruded coating of polytetrafluoroethylene. The resistivity per meter of a wire of type E30 is for example 0.36 ohm.

When using a power source of 220 V the heating power of one section is about 2.2 KW, which means a heating power of about 550 Watts per $m^2$ carpet and with a power source of 120V the corresponding values are 0.66KW and 160 watts per $m^2$.

The heating elements 2 in the two carpet sections 1*a* and 1*b* are connected in parallel to a control box 3, which may comprise a temperature-regulating system and is provided with a plug 4 for connection to the power supply.

Figure 2:
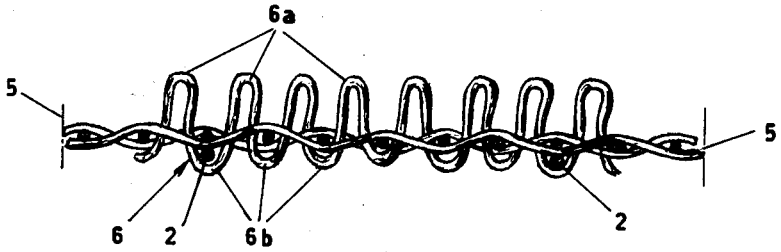

In the example shown in FIG. 2 the carpet consists of a backing 5, on which piles 6*a* are formed in some well-known manner, e.g. by pushing loops of a continuous thread 6 from the underside of the backing 5 through the meshes of the same upwardly.

As shown the heating wire 2 of the present invention can be simply woven into the carpet body by introducing it between the backing 5 and the loop portions 6*b* on the underside of the backing 5.

Also in a well-known manner the piles 6*a*, the loop portions 6*b* and the heating wire 2 may be bonded or locked to the backing. For example, a tacky liquid latex compound or hot polyethylene or other thermoplastic cement may be applied to the underside of the carpet structure shown in FIG. 2.

It will be understood that the invention is not limited to the example shown. In general, the heating wire 2 may be introduced for example as a selected weft thread in any well-known carpet weaving process.

I claim:

1. An electrically heatable floor covering comprising a carpet of woven electrically non-conducting fibers, wherein the improvement comprises an electrical heating element woven in the carpet as a weft thread in a zig-zag pattern covering the area of the carpet, said heating element being made of a stranded wire having a resistivity per meter of about 0.36 ohm, and being composed of a plurality of copper filaments each of which has a diameter of about 0.1 mm and is covered with a reinforcing coating of polytetrafluoroethylene which causes the wire to withstand impressions produced by footsteps and by heavy furniture without being broken, the total wire length being about 15 m. per square m.

* * * * *